United States Patent [19]

David

[11] 4,369,587

[45] Jan. 25, 1983

[54] DRIER FOR SCREEN PRINTED SHEETS

[76] Inventor: Bernard David, 20, rue de Rambervilliers, 75012 Paris, France

[21] Appl. No.: 199,917

[22] Filed: Oct. 23, 1980

Related U.S. Application Data

[63] Continuation-in-part of Ser. No. 51,414, Jun. 25, 1979, abandoned.

[51] Int. Cl.[3] ..... F26B 15/14

[52] U.S. Cl. ..... 34/150; 34/236; 198/644; 198/650

[58] Field of Search ..... 198/644, 650; 271/DIG. 10; 34/150, 236, 162, 163

[56] References Cited

U.S. PATENT DOCUMENTS

| | | | |
|---|---|---|---|
| 973,422 | 10/1910 | Gifford | 34/150 |
| 3,070,897 | 1/1963 | Lowe | 34/150 |
| 3,079,704 | 3/1963 | Wassem | 34/150 |

FOREIGN PATENT DOCUMENTS

| | | | |
|---|---|---|---|
| 403711 | 12/1933 | United Kingdom | 271/80 |

*Primary Examiner*—Larry I. Schwartz
*Attorney, Agent, or Firm*—Michael J. Striker

[57] ABSTRACT

This drier for serigraphic-process screen printing sheets comprises an endless conveyor supported by a frame structure associated with means for blowing non-heated air onto the sheets. The conveyor comprises in combination, a plurality of trays each comprising a solid air-tight support surface mounted on a frame, a deflector edge fixed to the side of the frame of a tray adjoining the conveyor, a plurality of nippers placed on said deflector edge, means for hinging each tray to the conveyor, said combination of means allowing a current of air coming from the deflector side to reach a very high speed without damaging or blowing away the sheets supported by the trays.

10 Claims, 7 Drawing Figures

DRIER FOR SCREEN PRINTED SHEETS

RELATED APPLICATION

This application is a continuation-in-part of Ser. No. 051,414 filed June 25, 1979 and now abandoned.

FIELD OF THE INVENTION

The present invention relates to a drier for sheets printed by serigraphy or silk screen printing.

As is known, drying of sheets printed by serigraphy is carried out at the present time either manually by stacking drying trays one on the other on each of which is disposed a sheet, or mechanically by means of driers in which air is blown onto moving sheets.

A first known type of embodiment is thus formed by a rectilinear tunnel inside which is disposed an endless belt, an infra-red or similar heating device being complementarily placed in the tunnel in association with an air ventilation system. At the outlet of the tunnel, the sheets are dry and are withdrawn from the machine.

These tunnels are extremely cumbersome, consume furthermore a great amount of energy for heating, which makes their operation expensive, and they prevent accurate positioning because the heat dries and consequently distorts the sheets. Finally, they can only be used with series of inks designed for them, thus limiting the choice open to the user.

A second known embodiment consists of an endless conveyor moving around shafts placed at its ends, and supporting trays on which the printed sheets are placed. This type of drier has many drawbacks: it is as long as the hot pulsated air tunnels because only an extremely weak air current, or no air current at all, enables the sheets simply laid on the perforated trays to remain in position. The insufficiently rigid sheets may contact the adjacent trays or contact each other when passing between the rods forming the trays, which forbids the introduction of thin or flexible supports therein.

When a sheet introduced at the inlet end arrives at the other end, it leaves the top of its tray to settle on the back of the preceding tray.

When the tray which was at the top of the conveyor is at the bottom thereof, due to its rotation about the end shafts of the conveyor, the sheet slides onto the back of its new tray and stops on tray rod end extensions bent rearwards in the form of a hook. This sliding movement must be very short with respect to the format of the sheet so as to prevent this latter from skewing. The format of the transported and dried sheets must then be close to the maximum format accepted by the drier considered. The result in any case is a parasite lateral movement of the sheet which prevents any lateral withdrawal thereof by a precise means such as nippers, suction cups, etc.

The removal of sheets in this type of drier takes place in the following manner: the sheets fall forwards thereof from underneath, aided most often by conveyor belts. The falling of the sheets is very imprecise and causes multiple troubles. Finally, the user must frequently step in to empty the sheet holder whose capacity is necessarily reduced because of its inconvenient position between the ground and the bottom of the drier.

SUMMARY OF THE INVENTION

The invention aims at remedying these disadvantages by providing a drier of the second above-mentioned type, i.e. comprising an endless conveyor supported by a chassis and to which are fixed trays adapted to receive the sheets, as well as a device for blowing air thereon in order to dry them during their movement on the conveyor. To this end, the drier comprises a combination of arrangements which enable it:

to contain sheets of any weight and flexibility usually used in serigraphy;

to contain sheets from the maximum format (format of the tray) to about 1/25th of this format (by way of example, a drier with a format of 0m80×1m20 may receive any format down to about 0m20×0m15);

to avoid any contact between sheets;

to allow turning round at the rear of the drier with neither displacement nor creasing of the sheets;

to allow precise lateral pick-up of the sheets from a horizontal tray, i.e. at about 1m20 from the ground for a drier having a tray format of 0m80×1m20. This arrangement allows use to be made of a conventional printing press reception means;

to allow shortening of its length by very heavy carefully orientated ventilation for drying the sheets (the greater the ventilation, the faster the drying) while pressing them against their support tray;

to prevent the sheets from slipping or from following the air currents;

to avoid any distortion of the sheets to be dried because of the absence of heating of the air.

The present invention provides a drier for sheets printed by serigraphy comprising an endless conveyor supported by a chassis and to which are fixed trays adapted to receive sheets and a device for blowing air on said sheets so as to dry them during their movement, which drier is characterized in that it comprises in combination:

a plurality of trays each of which comprises a solid air-tight support surface mounted on a frame;

a deflector edge fixed to the side of the frame of each tray adjoining the conveyor;

a plurality of nippers placed on said deflector edge;

and means for hinging each tray to the conveyor, said combination of means allowing a current of air coming from the deflector edge side to reach a very high speed which ensures a very high drying rate without for all that, damaging or driving the sheets supported by the trays.

In accordance with the invention, the drier comprises trays having a metal frame. On this frame is stretched a material impervious to the air currents covering the whole surface of the tray. Three sides of the frame may be made from a metal rod bent at the corners of the tray, whereas the fourth side adjoining the conveyor is made from a rigid section (for example made from bent metal sheet) acting both as air deflector and support for a row of nippers.

These trays whose number may vary from one to several hundred depending on the speed of the machine with which the drier is associated, travel step by step in the upper part between two walls parallel to the conveyor, swept by a strong air current, this air current having to come necessarily from the conveyor direction. To obtain a high air speed without for all that increasing the flowrate thereof, the drier is separated into several ventilation sections, the air leaving the top of one section to be brought by an appropriate duct to the bottom of the next section. The ducts which convey the air from the top of one section to the bottom of the next one will be advantageously disposed successively on the right and on the left of the drier so as to better distribute the ventilation. Furthermore, a part of the air will be recycled so as to avoid flow rates which are too high in the ventilation chimneys.

The trays in the upper part of the drier are sloped by about 25° with respect to the vertical so as to avoid the sheets of flexible material from creasing and falling on themselves, which would result immediately in making these sheets unusable, since the ink is fresh at the outlet of the drier. A sheet placed either manually or automatically by an arm with nippers or suction cups on a solid tray is supported over the whole of its surface; it is nipped by the lower edge along the base of the tray. The deflector edge of the tray prevents the air current from passing under the sheet (which would cause it to flap and touch the back of the preceding tray); on the contrary, with the air current passing over the sheet, it tends to press it further on its support tray. Under these conditions, passage in the upper part of the drier with ventilation is achieved while completely preserving the impression which may cover practically the whole surface of the sheet.

At the end of this travel, the sheet is sufficiently dry to go into the rear end zone in which the upper trays turn about the shafts of the conveyor to reach the lower part.

The drier is constructed so that at the moment when the conveyor is stopped, with a tray in a horizontal position for loading and unloading a sheet in the front part, the last tray of the upper row of trays is now only inclined by about 20° rearwards, having already penetrated into the rotation zone of the rear end pinions of the drier. These pinions comprise about 12 teeth preferably; the movement by one step causes rotation through an angle of 30°; thus, the tray which just before this movement was sloped rearwards by about 20° with respect to the chain of the conveyor, will rapidly assume a vertical position and continue to 10° forwards through rotation of the pinion, and through its own momentum will straighten up perpendicularly to the conveyor, thus describing 25° more than the rotation of the pinion, i.e. in all 55°. It will not go beyond, a stop preventing it from sloping forwards with respect to the conveyor.

This sudden rotation of 55° is required so that insufficiently rigid materials do not crease and do not fall on themselves, when assuming the vertical position. The beginning of rotation of 5° of the next tray, effected at each new rotation, is necessary so that an intake of air at the moment of the 55° rotation does not suck in a light sheet placed on the adjacent tray. After the 55° rotation, the sheet considered rests on the back of the tray which receives it. It describes, as the drier rotates, the end of the curve to then assume the vertical position under the conveyor, then it returns step by step to the entrance of the drier. This return travel is effected without ventilation, it allows however the last solvents to escape and the ink to harden. Arriving at the inlet pinions, the trays rise to the top of the conveyor. On going over to the horizontal position, each tray is directed and locked in a precise position to allow the use of rows of nippers or suction cups.

At this stage, since the tray has just been locked, the tray nippers are open, the sheet is gripped by an arm fitted with nippers or suction cups and transported out of the tray. A new sheet is then inserted either manually or automatically, the nippers of the tray are closed again, the tray is unlocked, the conveyor driven by a shaft fitted with gears rotates by one chain pitch. The next tray is immobilized in the horizontal position and the cycle is reproduced as many times as there are sheets to be dried.

BRIEF DESCRIPTION OF THE DRAWINGS

The accompanying drawings illustrate by way of example one embodiment in accordance with the invention.

DESCRIPTION OF THE PREFERRED EMBODIMENT

Figure 4:
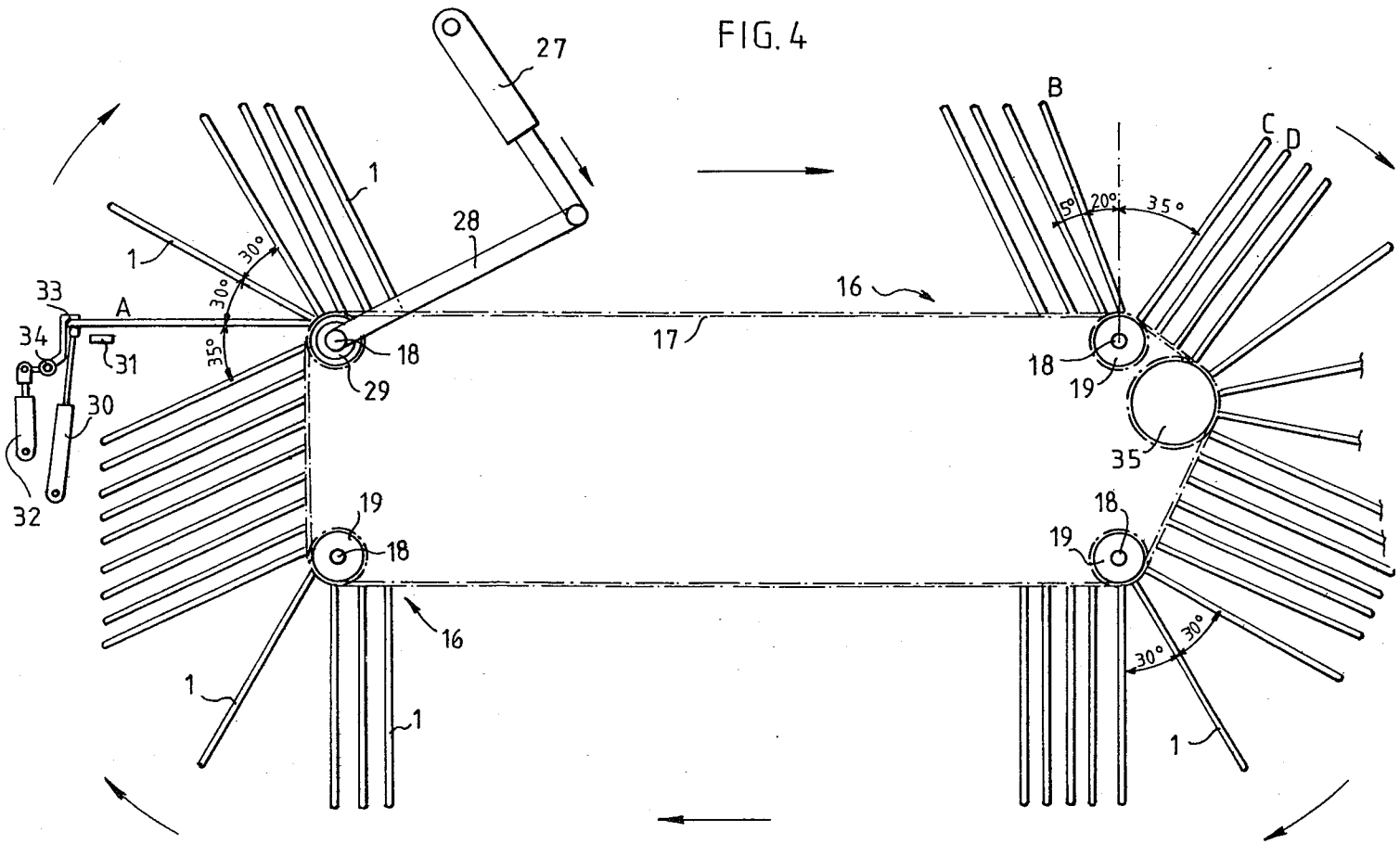
FIG. 4 is a schematized elevational view of the conveyor equipped with its trays.
Figure 5:
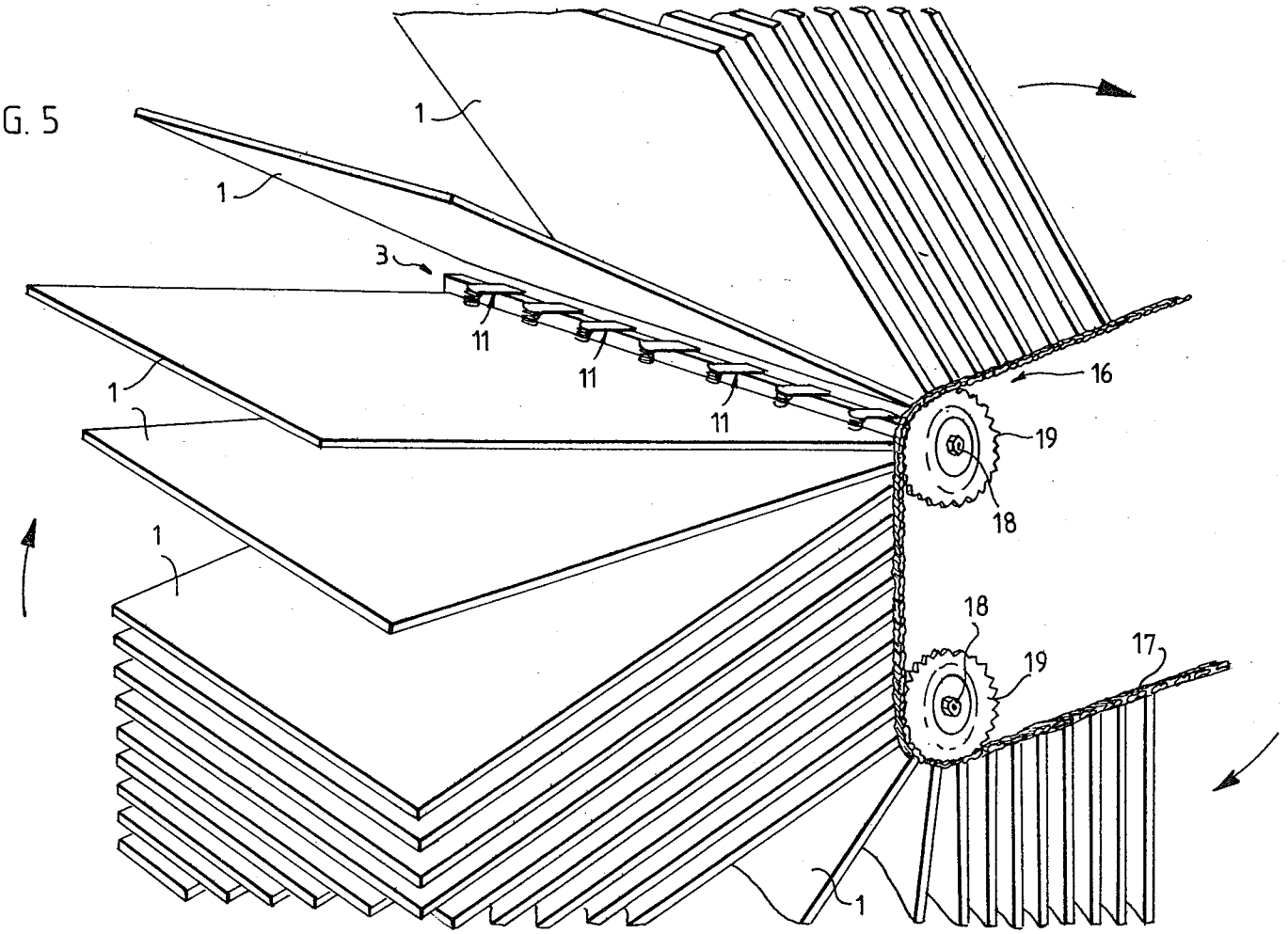
FIG. 5 is an enlarged partial perspective view of an inlet end of the drier showing an assembly of holding nippers fitted to a tray.

Referring first of all to FIGS. 4 and 5 of the drawings, it can be seen that the drier for sheets printed by serigraphy comprises an endless conveyor formed in a way known per se by two chains such as 17, turning in vertical parallel planes about superposed end shafts 18 with which pinions 19 are rigidly locked. This conveyor is supported by a duct forming chassis 20, in the middle of which there is disposed an air-blowing device 21 of a type known per se.

The drier of the invention comprises (FIG. 1) trays 1 each formed from a bent rod 2, forming three sides of the tray, and an edge made from a bent metal sheet 3, serving both as deflector and as support for a row of nippers. This edge is secured by welding 3*a* to rod 2, it comprises stiffening folds, including the fold 3*b* situated perpendicularly to the surface of the tray on the top side thereof, and which serves as an air deflector. On edge 3 there is provided a series of nippers 11, (of the order of 7 nippers per meter). A stiffener 4 formed from a bent metal rod is welded at three points to the periphery of the tray so as to prevent any lateral distortion thereof. Two lugs 5 provided under the lateral rods of the tray at the free end thereof serve to prevent a tray from contacting its neighbour. Threaded extensions 2*a* of rod 2 serve for securing the tray to the conveyor. Finally, an air-tight cloth 6 bonded to the frame covers the whole surface of the tray. The material of the cloth is chosen so as to be able to be subsequently stretched by wetting with water.

Figures 1, 2, 2A:
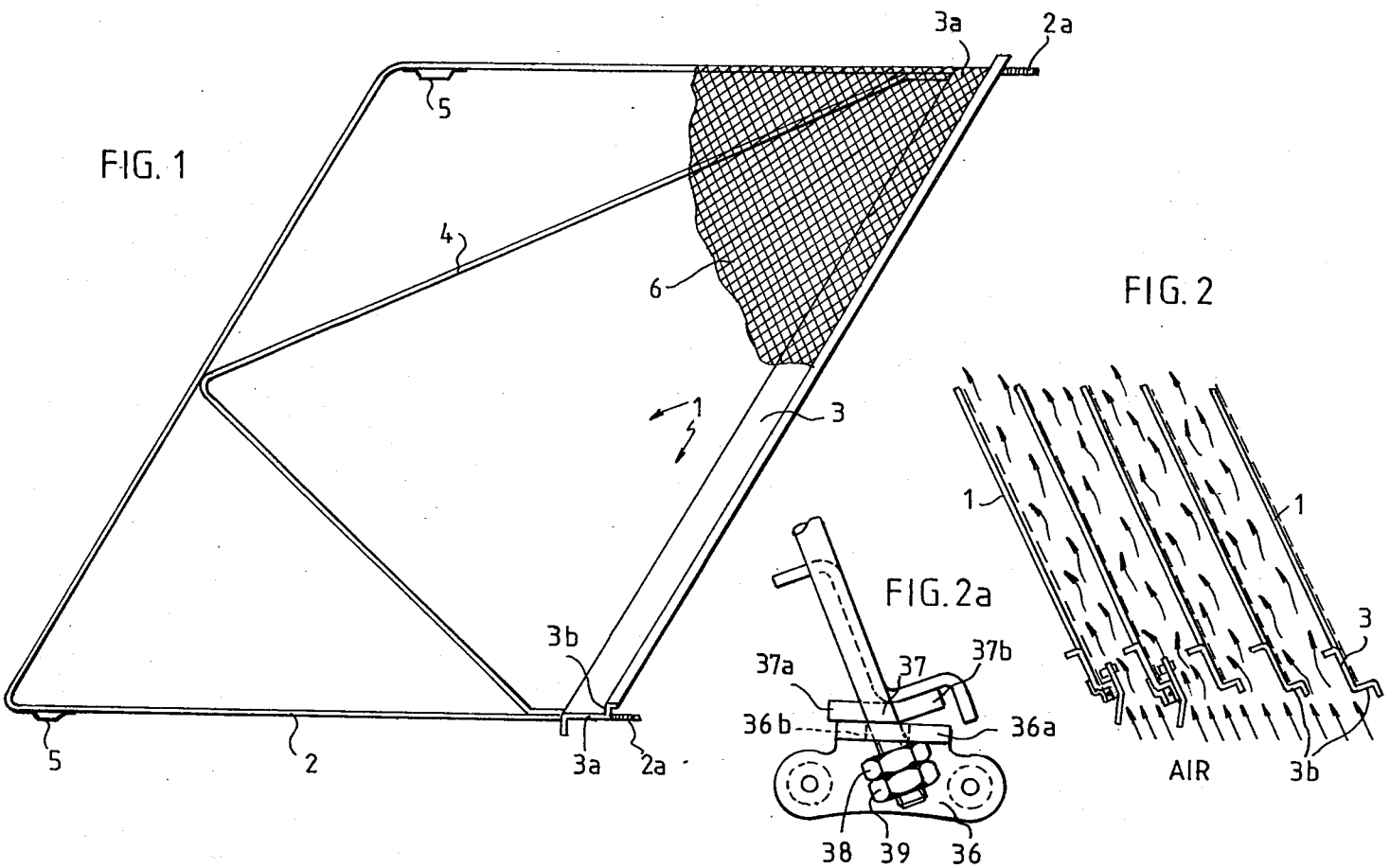
FIG. 1 is a perspective view of a tray forming part of the drier.
FIG. 2 shows the behaviour of the air in the trays.
FIG. 2*a* shows in perspective the system for hinging the trays to the conveyor.

Chains 17 are chains of the type having conventional lateral lugs, comprising one lug 36*a* per link 36, all disposed on the same side of chain 17 (see FIG. 2*a*). These lugs 36*a* comprise a hole 36*b* whose diameter is sufficiently large for the extensions 2*a* of trays 1 to be able to penetrate therein and to swing inside through an angle of 25° on each side of the axis of hole 36*b*. A washer 37, welded to the extension 2*a* at the edge 3 of the tray, comprises a bend separating the washer 37 into two zones: one zone referenced 37*a* forming an angle of about 25° with the plane perpendicular to rod 2; this zone 37*a* limits to about 25°, by abutment on lug 36*a*, the rearward slope of tray 1. A zone referenced 37*b* perpendicular to rod 2 limits by abutment on lug 36*a* the forward position of tray 1 perpendicularly to chains 17.

A nut 38 and a lock nut 39 screwed on to the extension 2*a* provide for adjustment of the clearance and securing of tray 1 to chains 17 of conveyor 16.

Figure 3:
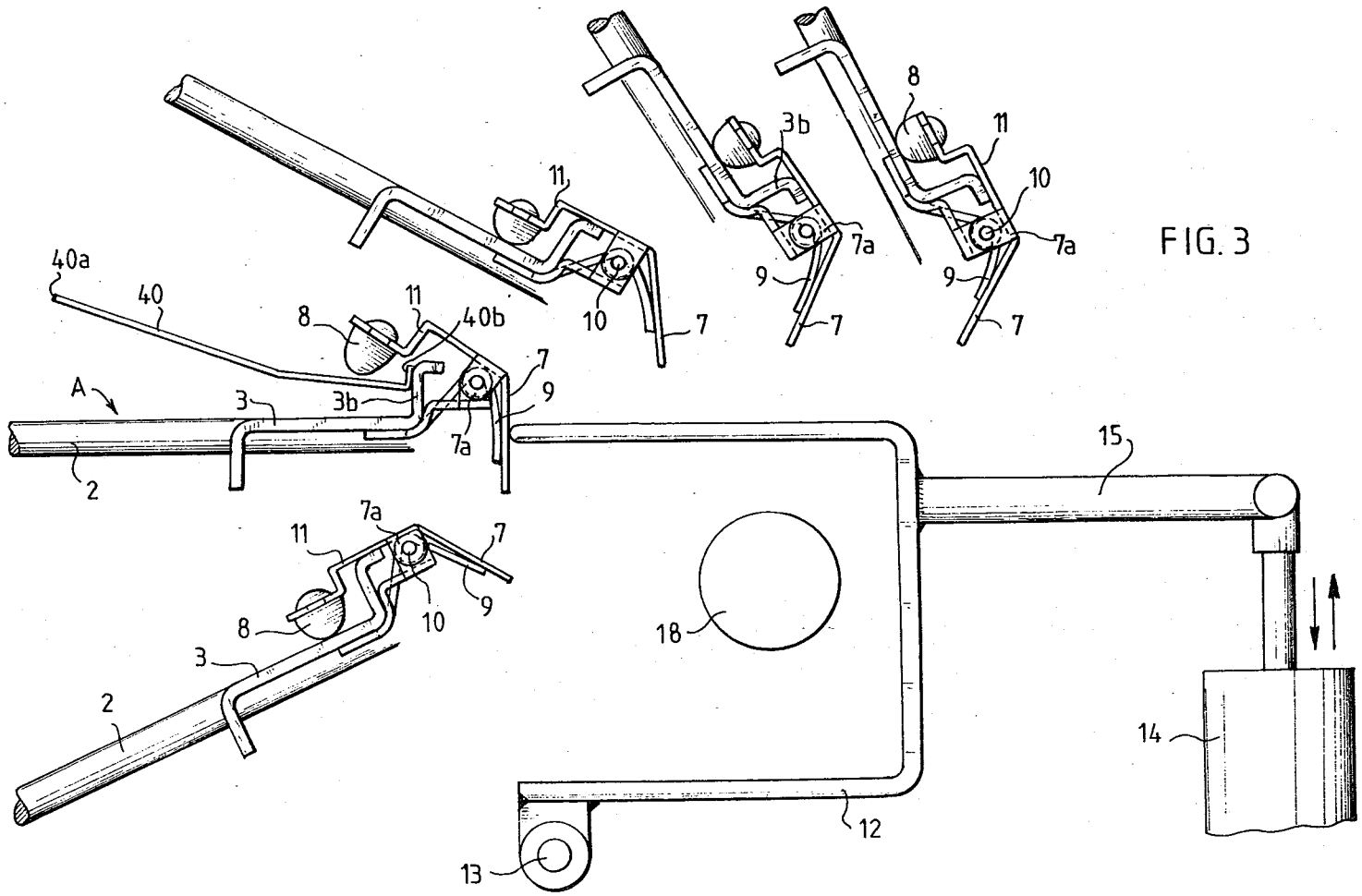
FIG. 3 is an enlarged elevational view showing the kinematics of the automatic opening of holding nippers.

Referring to FIG. 3, there are shown therein nippers 11 formed by elements 7 made from bent metal sheet having a nose 8 made from elastomer for securely gripping the heaviest sheets; they are hinged by flanges 7*a* having a through-hole for receiving a split hinge pin 10; this pin also serves for supporting the spring wire 9 which holds nose 8 against the sheet.

Opening and closing of nippers 11 take place when the tray considered is horizontal at the entrance to the drier (the position shown at A in FIGS. 3 and 4). They are controlled by a U-shaped member 12 whose length is sufficient to open the whole row of nippers of a tray. This member 12 is hinged on a pin 13, it is operated by a pneumatic jack 14 through a lever 15 welded to member 12. FIG. 3 shows the row of nippers 11 open for the exchange of sheets, the rod of jack 14 being extended. Closing of nippers 11 is obtained by retraction of the rod of jack 14. Lever 15 drives member 12 which pivots rearwards about pin 13. The row of nippers 11 closes again The next tray assuming in its turn the horizontal position, the rod of jack 14 extends and again causes opening of nippers 11.

Figure 6:
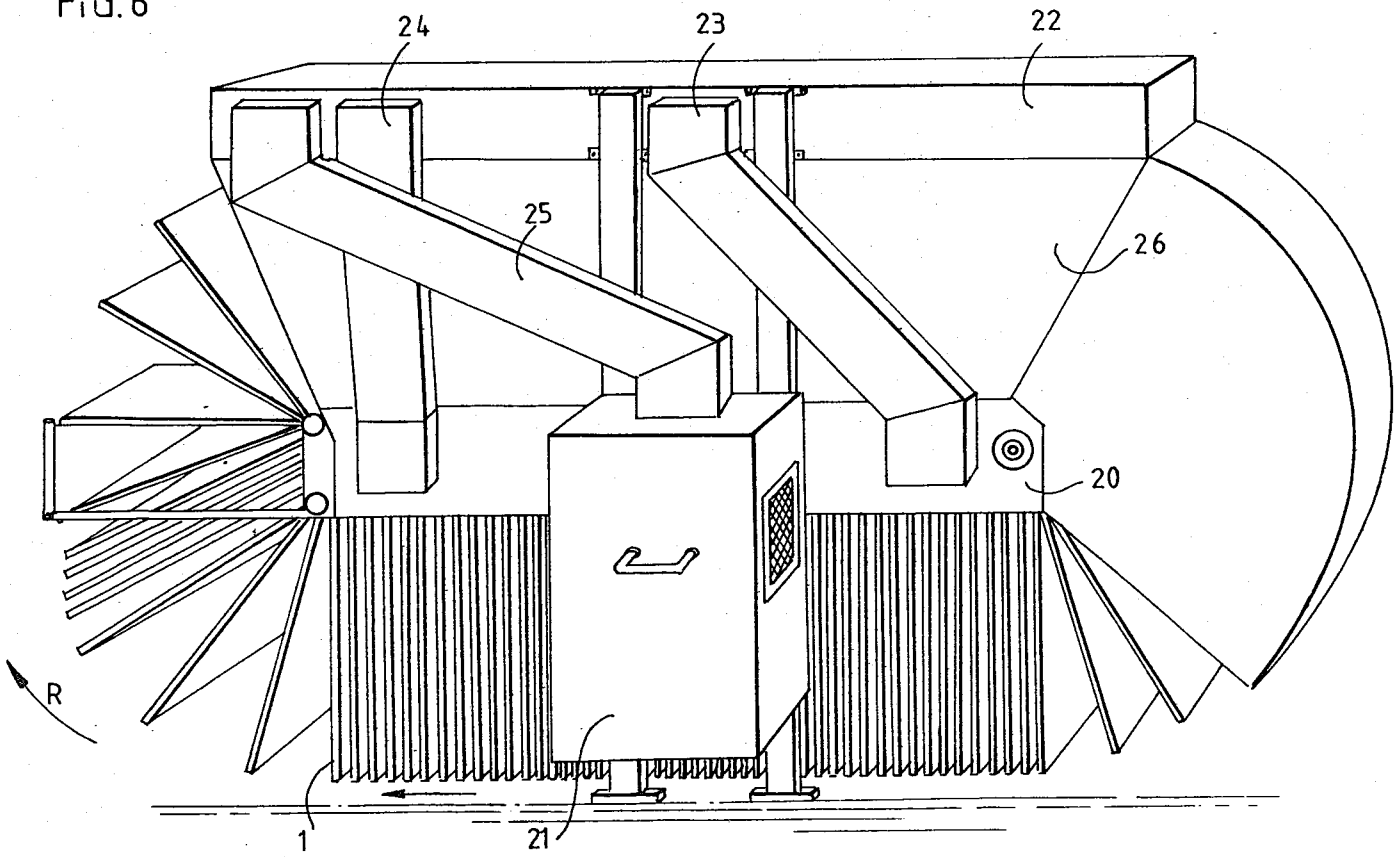
FIG. 6 is a perspective view of the whole of the drier according to the invention.

Referring to FIGS. 4, 5 and 6, there can be seen a drier for sheets printed by serigraphy comprising an endless conveyor 16 constructed in a way known per se from chains such as 17 rotating in parallel vertical planes about superposed end shafts 18 to which pinions 19 are firmly secured. This conveyor 16 is supported by a duct-forming chassis 20 in the middle of which is disposed an air-blowing device 21 of a type known per se. The air is blown into the central part of the drier and rises between the trays (FIG. 2). It is taken up in the upper part by a horizontal duct 22 then is brought by ducts such as 23 and 24 situated on the two faces of the drier back to the duct-forming chassis 20 where it is again blown between the trays from the bottom. A part of the air is recycled through duct 25.

Trays 1 carried by conveyor 16 travel between the lateral walls 26 with the least possible clearance (a few millimeters) so as to avoid lateral air currents which could cause the sheets to flap.

With a sheet fed on to tray 1 at position A, the cycle is set off either manually or automatically. Nippers 11 close, jack 32 causes the two flat hook-shaped members 33, situated in front of the tray a few centimeters from the lateral edges thereof, to pivot about pins 34. These members 33 free the tray at the same time as the rod of jack 30, situated in the center of the front of the tray, retracts. At that moment, the rod of jack 27 extends driving lever 28 which, through the free wheel 29, drives shaft 18 and its pinions 19 which cause the conveyor to rotate. At the beginning of the movement of the rod of jack 27, jack 32 comes back to its starting position replacing the two hooks 33 in the path of the trays. The rod of jack 27 continues its travel and a new tray presents itself in the vicinity of position A. This tray then meets a micro-contact 31 which, on the one hand interrupts the travel of the rod of jack 27 and causes its return to it original position, free wheel 29 allows this return without movement of conveyor 16; the tray is stopped a little below position A. On the other hand, micro-contact 31 actuates the rod of jack 30 which extends and corrects the level of the tray exactly in position A. The distance between the upper front and rear shafts 18 is determined so that with a tray in position A at the front of the drier, a tray is in position B at the rear of the drier, position B being that of a tray whose chain link to which it is attached has left the horizontal part of the conveyor to be engaged in a rotation of 5° on the upper rear pinion 19 supporting the conveyor. This tray is now only sloped by 20° with respect to the vertical; the difference of 5° with the tray which precedes it will enable, at the next rotation of a chain pitch, the tray 1 situated in position B to pass to position C without drawing up the sheet situated on tray 1 which follows it. The sheet which is attached to tray 1 reaching position C, rests on the back of the preceding tray 1, referenced position D in FIG. 4; it will rest on the back of the preceding tray 1 until it arrives under the conveyor where it will hang down till it is discharged from the drier on reaching position A.

A pinion 35 having about 20 teeth is placed on each chain between the two pinions 19 at the rear of the drier, so that the chain leaving the horizontal moves in an oblique direction downwards by an angle of 35°, thus allowing tray 1 which has just tilted to come parallel to tray 1 which precedes it, which avoids the transported sheet from being thrown forwards beyond the position of tray 1 which has just tilted.

It happens that the printed media are not quite flat, but on the contrary that their edges are raised. It is then difficult and sometimes impossible to introduce the edge of such media under the nose 8 of nippers 11, which only open by about 5 to 10 mm. To avoid this disadvantage, at the side of each nipper 11 is disposed a sheet-laying device 40. This sheet-laying device 40 is formed by a flat metal rod welded to the edge 3 of trays 1, by its bent end 40*b*. It has a length of several centimeters; at the edge 3 the sheet-laying device 40 is at a few millimeters from the plane of tray 1 (distance necessarily less than the opening height of nippers 11 to guide the sheet under the nippers), it extends from edge 3 in a plane perpendicular thereto while moving away from the plane of tray 1, its free end 40*a* is at 20 mm or so from the plane of tray 1.

The essential advantages of this drier are, in comparison with existing driers, that it is able to accept all the usual media used in serigraphy, dry them without distorting them, which allows impressions with precise positioning, dry them in a minimum of space and dry them with very low energy consumption.

The invention is not limited to the embodiment described and may comprise variations. The tilt angles of the trays and the number of teeth of the pinions have only been given for the sake of explanation: they may be varied slightly more or less.

It will be understood that each of the elements described above, or two or more together, may also find a useful application in other types of constructions differing from the types described above.

While the invention has been illustrated and described as embodied in a drier for screen printed sheets, it is not intended to be limited to the detail shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A drier for sheets printed by serigraphy, comprising a chassis formed as a duct; an endless conveyor supplied by said chassis; a plurality of sheet-receiving trays hingedly connected with said conveyor and each having a frame and a solid air-tight sheet support mounted on said frame, said frame of each of said trays having one side which is adjacent to said conveyor and is hingedly connected with the latter; a deflector edge fixed to said one side of said frame of each of said trays; a plurality of nippers placed on said deflector edge at said one side of said frame of each of said trays; means for hingedly connecting said trays to said conveyor and being connected with said one side of said frame of each of said trays and with said conveyor; an air-blowing device connected with said duct-forming chassis, so that a current of air blown by said air-blowing device is directed by said duct-forming chassis to a bottom of each of said trays and then travels between said trays; means for immobilizing said trays in a predetermined position; means for correcting a position of said trays; cooperating means which cooperate with said immobilizing and correcting means for alternately releasing the same from said tray and replacing them in a path of said trays; means for rotating said conveyor with said trays; and a micro-contact placed in the path of said trays and arranged so that it interrupts the operation of said means for rotating said conveyor and actuates said cooperating means for correcting a next one of said trays so as to put the same exactly to a position where a wet sheet is to be placed.

2. A drier as defined in claim 1, wherein said cooperating means and said rotating means are formed as pneumatic means.

3. A drier as defined in claim 1; and further comprising lateral walls between which said trays move, said frame of each of said trays having a lateral stiffening member increasing the rigidity of the former in a respective direction, so as to allow reduced clearances between said trays and said lateral walls.

4. A drier as defined in claim 1; and further comprising means for maintaining an even distance between said trays, said trays having lateral edges having ends, and said maintaining means including pieces secured at said ends of said lateral edges of said trays.

5. A drier as defined in claim 1; and further comprising a sheet-laying device situated close to each of said nippers and arranged for laying an edge of sheets, thus allowing the sheets to be fed whether they are flat or not.

6. A drier as defined in claim 5, wherein said sheet-laying device is arranged in the region of said one side and said deflector edge of said trays so as to act upon the sheets substantially in said region.

7. A drier for sheets printed by serigraphy, comprising a chassis formed as a duct and having a front and a rear; an endless conveyor supported by said chassis; a plurality of sheet-receiving trays hingedly connected with said conveyor and each having a frame and a solid air-tight sheet support mounted on said frame, said frame of each of said trays having one side which is adjacent to said conveyor and is hingedly connected with the latter; a deflector edge fixed to said one side of said frame of each of said trays; a plurality of nippers placed on said deflector edge at said one side of said frame of each of said trays; means for hingedly connecting said trays to said conveyor and being connected with said one side of said frame of each of said trays and with said conveyor; an air-blowing device connected with said duct-forming chassis, so that a current of air blown by said air-blowing device is directed by said duct-forming chassis to a bottom of each of said trays and then travels between said trays; means for rotating said conveyor; and means at said rear for reversing a position of said trays with respect to a vertical and accelerating their passing over the vertical, said rotating means including two rear pinions spaced from one another, and said reversing means including an intermediate pinion arranged between said rear pinions so as to cause said conveyor to assume an oblique path, said intermediate pinion having a number of teeth exceeding that of said rear pinions and thereby causing said trays to pass rapidly to a vertical position and rotation at said rear of said trays loaded with sheets, while preventing the sheets from creasing by falling on themselves.

8. A drier as defined in claim 7, wherein said conveyor has a chain to which said trays are hingedly connected, said intermediate pinion having such a position that said chain leaving a horizontal moves obliquely downwards at an angle of about 35°, thus allowing a tray which has just tilted to be parallel to a tray which preceeds it.

9. A drier for sheets printed by serigraphy, comprising a chassis formed as a duct; an endless conveyor supported by said chassis and including a chain having a plurality of lugs with a hole in the latter; a plurality of sheet-receiving trays hingedly connected with said conveyor and each having a frame and a solid air-tight sheet support mounted on said frame, said frame of each of said trays having one side which is adjacent to said conveyor and is hingedly connected with the latter; a deflector edge fixed to said one side of said frame of each of said trays; a plurality of nippers placed on said deflector edge at said one side of said frame of each of said trays; means for hingedly connecting said trays to said conveyor and being connected with said one side of said frame of each of said trays and with said conveyor, said hingedly connecting means including extensions which are integral with said frame of each of said trays and fit into a respective one of said holes of said lugs of said chain, said extensions of said frames of said trays carrying a washer with one part extending at an angle to a plane perpendicular to a respective one of said extensions.

10. A drier as defined in claim 9, wherein said one part of said washer extends at an angle of substantially 25° to a plane perpendicular to a respective one of said extensions.

* * * * *